United States Patent [19]

Brumlik

[11] 4,017,659

[45] Apr. 12, 1977

[54] TEAM LATTICE FIBERS

[75] Inventor: George C. Brumlik, Montclair, N.J.

[73] Assignee: Ingrip Fasteners Inc., Montclair, N.J.

[22] Filed: Oct. 17, 1974

[21] Appl. No.: 515,792

[52] U.S. Cl. ..... 428/397; 428/364; 428/370; 428/374

[51] Int. Cl.[2] ..... B32B 9/00; D02G 3/00

[58] Field of Search ..... 161/172, 175, 177, 180, 161/176, 173; 428/397, 400, 369, 370, 371, 364, 374, 392, 393, 394, 395

[56] References Cited

UNITED STATES PATENTS

| | | | |
|---|---|---|---|
| 3,030,248 | 4/1962 | Runton | 161/176 |
| 3,393,120 | 7/1968 | Toucy et al. | 161/173 |
| 3,402,096 | 9/1968 | Blanchette | 161/173 |
| 3,500,627 | 3/1970 | Kim | 161/177 X |
| 3,681,189 | 8/1972 | Matsui et al. | 161/177 X |
| 3,775,228 | 11/1973 | Leary | 161/176 X |

*Primary Examiner*—Lorraine T. Kendell
*Attorney, Agent, or Firm*—Burgess, Dinklage & Sprung

[57] ABSTRACT

Team lattice fibers are disclosed. These fibers consists of two or more axial members connected by transverse bridges. The bridges may be separate components or may be formed by undulations in a linear member joined to one or more other members at points of contact or intersection. The purpose of the present invention is to separate the variables of fiber characteristics between the components of the fiber of the present invention.

Another purpose of the invention is to produce fibers commanding exceptionally large bulk. A further purpose of the invention is to obtain control of the structure of the virtual space of the fiber and fabrics formed from the fiber.

Another purpose of the present invention is to utilize textile wastes such as fiber fines by incorporating these into the engineered fibers of the present invention. A further object of the invention is to produce fibers with controlled stiffness.

3 Claims, 42 Drawing Figures

TEAM LATTICE FIBERS

BACKGROUND

This invention relates to structural fibers comprising two or more axial members connected by bridge members oriented transverse to the axes of the linear members.

Most commerically available man-made fibers are smoothly continuous and lack variation from point to point along the length of the body of the fibers. This lack of elements of diversified structural evolution has the following consequences: (1) The virtual volume which the fiber commands is limited and (2) the conventional fibers fail to present a possibility for a separation of their property variables such as is provided by the fibers of the present invention.

DESCRIPTION

Figure 1:
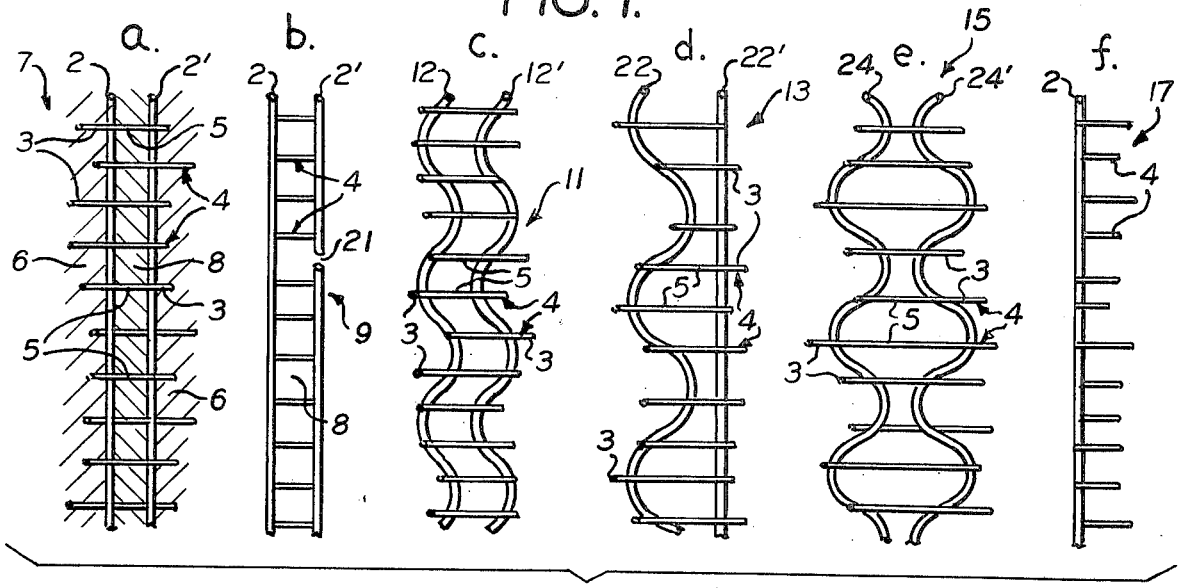
FIGS. 1*a* through *f* are side elevational views of a section of team lattice fibers of the present invention depicting axial elements connected to transverse elements.

The textile fibers of the present invention consist of team fibers that are connected together with lateral bridges composed of fibers or fibrils. This structure provides many valuable features not obtainable in conventional fibers and achieves great saving in materials. Since several structural components from the fiber body, a large number of combinations can be obtained. Such conbinations involve structure, physical and chemical properties. It is the purpose of this invention to provide means over the separation of property variables, such as are not available in conventional or natural fibers. For example, if a conventional fiber is desired to produce soft fabrics, its diameter has to be decreased and this decrease is accompanied by a loss in tensile strength per fiber. The structure of the fibers of the present invention, in contrast to the conventional fibers, enables the separation of variables, since each component may provide unique properties of its own which are independent of the properties of a second structural component. For example, tensile strength, toughness and lateral stiffness may be provided by one of the axial members, while the characteristics of bulk, softness, thermal insulation, flame retardancy, moisture absorption, color, and sheen are embodied in the other componets of the structured fiber of the present invention.

A further object of the present invention is to incorporate into the team lattice fibers the ability to control and dominate the "virtual space". Virtual space is that volume which controls the total bulk of the fiber and which can attain in the team lattice fibers magnitudes far larger than is found with conventional fibers. This large virtual volume is structurally defined and combined with other unique properties of the described fibers yields fabrics of exceptional lightness and softness. It is a further object of this invention to utilize textile and other fibrous wastes such as fines, silk noil, and cotton linters by incorporating these into the fiber structure of the present invention. Cotton litners, for example are utilized as a material of the bridge component and provide at the same time their valuable property of moisture absorption.

Incorporation of textiles wastes to form valuable fibers affords great saving in materials and costs. Additional savings arise from the increase in virtual volume commanded by the structure of the team lattice fibers.

The term "lattice fibers" is used herein to generically describe a new type of structural fiber comprising two or more slender elongated (axial) elements travelling together and held in a common linear unit by bridge elements periodically disposed along the length of the said structural fibers.

Referring now to the drawing, the linear elements 2 and 2' are joined together at consecutive intervals by crosswise bridge elements 4. The bridge elements 4 contact and/or cross the linear elements 2 and 2' and are bonded to them at the points of intersection or contact thus forming a bridge 5. The bridge elements may be separated at any predetermined sequence of distances, a variation which constitutes a physical memory built into the fiber and affords important variables not available in conventional febers. The angles at which the bridge units meet the elongated team members are variable and this variation and the variation of the angles in succession constitutes another fine measure of control. The team lattice fibers have the propensity to fill out a large virtual space, which in addition to its volume has characteristic structural attributes. The term "virtual space" is used to describe the space which the fiber precludes neighboring fibers to occupy. The virtual space if formed in the fiber of the present invention by means of its evolved gossamery structure. For example, the team lattice fiber 7 depicted in FIG. 1*a* contains two distinguishably different elements virtual space. Numeral 8 represents the 'inner" network space between the two accompanying linear elements. Numeral 6 represents the second variety of space, the "outer space", located within the described fiber along its outside faces where the bridge element cross and command by means of their overlapping extensions 3 additional space. The two described spaces 6 and 8 are only partially penetrable by other fibers brought into the proximity of the said team lattice fiber. This penetrability of the spaces corresponding to numerals 6 and 8 differs, and the magnitudes depend on the interaction of the structures of the fibers brought into contact.

Figure 2:
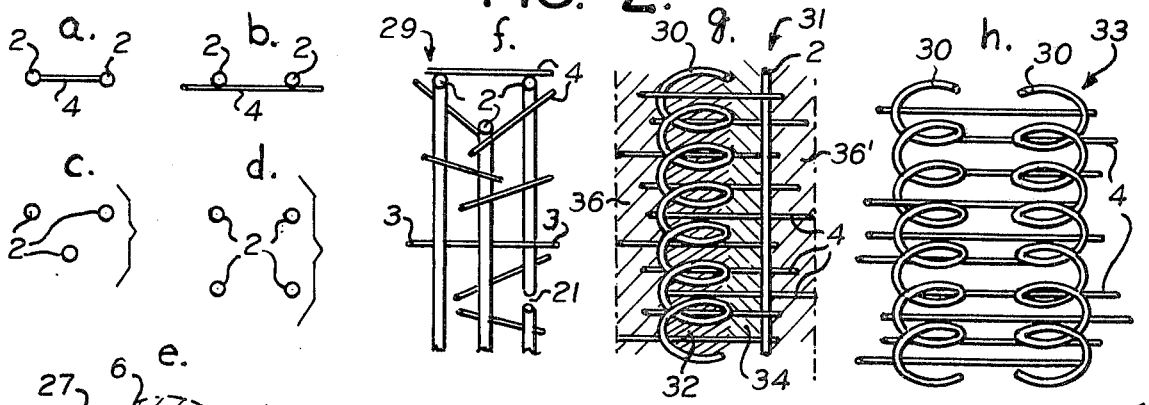
FIGS. 2*a* through *h* represent various possible geometry classes of the axial elements of the team lattice fibers as they are held together with the tansverse elements.

The element 9 of FIG. 2*a* has the bridge elements 4 terminating at the linear elements 2 and 2' and thus possesses only an inner virtual space. The axial elements 2 and 2' are marked differently to emphasize the point that the said elements may be equivalent or may differ in structural, physical and chemical properties. Such a variation can also occur with bridge elements 4 within the scope of the present invention. The axial members may exhibit discontinuities. The structural fiber represented by FIG. 2*c* comprises two undulating axial filaments 12 and 12' connected periodically by bridge elements 4 which may contact or cross the axial members 12 and 12' to form an extension or nib 3. The undulation of the axial elements may be in a plane or in three dimensions.

The form of the fibers represented by FIG. 2*c* may be obtained in a number of ways. For example, the linear team filament 9 may be distorted to undulate or spiral in space. Alternatively, undulating or crimped filaments 12 and 12' may have their crests, troughs and contortion affirmed by teaming them by means of bridge elements 4 into a coherent composite fiber. The composite fiber 13 of FIG. 2*d* comprises a straight axial filament 22' bridged to a contorted element 22.

FIG. 1*d* portrays a composite team fiber 15 comprising two bridged axial elements 24 and 24' whose relative distance and virtual space periodically vary. FIG. 1*f* represents a single axial element 2 carrying bonded bridge members 4.

The team lattice fibers may comprise a plurality of accompanying bridged axial elements larger than two. These axial elements may be arranged in a plane or in three dimensional space. FIGS. 2*a*, *b*, *c*, *d*, *e* show cross-sections of team lattice fibers comprised of 2, 4, 3, 4 and 6 axial members 2. While the axial fibers 2 in FIGS. 2*a* and *b* are in a plane, the axial elements 2 in FIGS. 2*c*, *d* and 3 define in the cross-sectional representation a triangle, a square and a hexagon. The axial elements 2 are bridged by elements 4. Two characteristic and different virtual space volumes are encountered in the structure of the team lattice fiber 27 represented by FIG. 2*e*. The inner rather inaccessible space 8, and the outer space 6 commanded by the end portions or nibs 3 of the bridge members 4. The composite fiber 29, represented in cross-section in FIG. 2*c* is shown in perspective in FIG. 2*f*. The three axial members 2 are connected by the bridging elements 4 to form a prismatic fiber 29 having protruding nibs 3. The axial members may lack continuity as illustrated by the gap 11. Tandem axial sequential continuation of axial fibers in the structure of the team lattice fibers falls within the scope of the present invention.

The composite fiber 31 of FIG. 2*g* comprises a helical axial member 30 bridged by elements 4 to a linear member 2. FIG. 2*g* illustrates the diversity of structure that is accessible in the area of the team lattice fibers. Four separate virtual space domains are present in the depicted fiber 31: the area 32 commanded by the helical axial member 30; the area 34 present between the helical axial member 30 and the linear axial member 2; the nib space at the helix 36; and the nib space 36' at the linear axial member 2. All four domains have their own separate characteristic properties. The composite fiber 33 of FIG. 2*h* comprises two helical members 30 and 30' of opposite helicity bridged by element 4.

The composite fiber 25 comprises a coarser inner axial tensile element termed "the leader element" 26 which is connected by rows of bridge members 4 to six slender outer axial filaments 28 termed the satellite filaments. The composite member 25 may be, for example, made by bonding a filament with grafted nibs (co-pending U.S. Pat. Application Ser. No. 401,084 now U.S. Pat. No. 3,953,647) to the linear elements 28.

Figure 3:
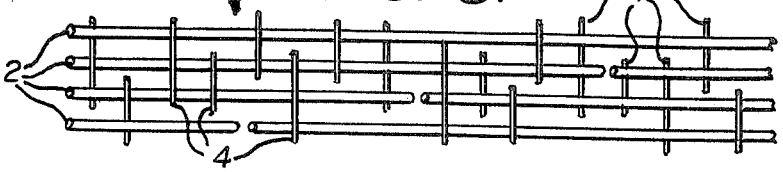
FIG. 3 is a side elevational view of a team lattice fiber of the present invention in which the axial elements are connected two or more at a time by transverse elements.
Figure 4:
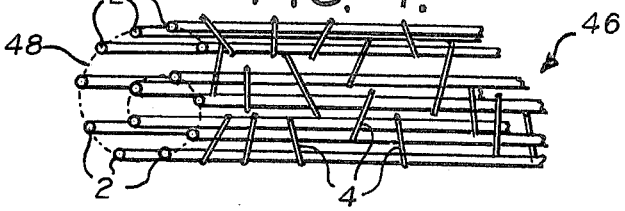
FIG. 4 is a perspective view of the team lattice fiber of the present invention having a three dimentional form of a scroll.

Another embodiment of the present invention is the composite ribbon shaped fiber 40 of FIG. 3 comprising axial elements 2 positioned parallel in proximity in a plane and bonded by bridge members 4. In this embodiment the individual bridge member 4 may bond only a fraction of the axial components 2 of the depcited ribbon structure. An extended ribbon structure may be rolled into a scroll-shaped composite fiber 46 represented in FIG. 4. The composite fiber 46 comprises axial members 2 bonded together by bridge elements 4 so as to position the parallel members 2 in a helical arrangement 48 when viewed in cross-section.

Figure 5:
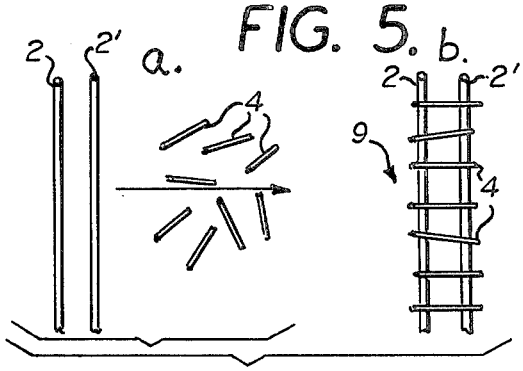
FIGS. 5*a* and *b* illustrate the formation of a team lattice fiber from axial elements and transverse elements.

Referring now to FIG. 5, the team lattice fibers can be conveniently made in a continuous manner by passing closely positioned axial members for example 2 and 2' through a mass of bridge members 4 and simultaneously bonding the axial members 2 and 2' and the bridge members together into a continuous integral composite filament 9.

Figure 6:
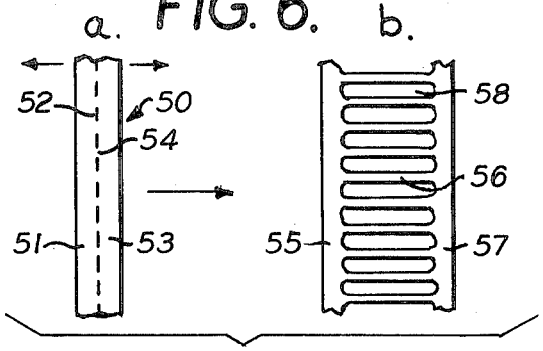
FIG. 6*a* is a cross-sectional view of ribbon cut from a sheet with slits along its axis of symmetry which is stretched in a crosswise direction to form a team lattice fiber of FIG. 6*b*, also shown in corss-section.

Alternatively, as shown in FIG. 6, a ribbon 50 cut from a sheet may be provided with slits 52 along or parallel to the axis of the ribbon and extended crosswise to form a teamed lattice fiber 58 having axial members 55 and 57 connected together by bridges 56.

Figure 7:
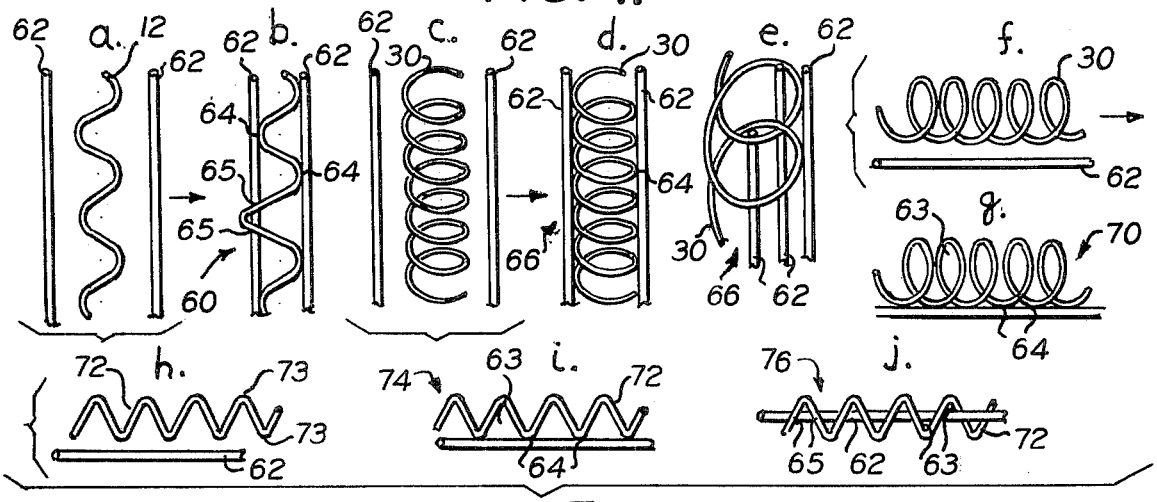
FIGS. 7*a* to *j* are side elevational views of team lattice fibers comprising linear elements attached to wavy or spiral elements before and after attachment.
Figure 8:
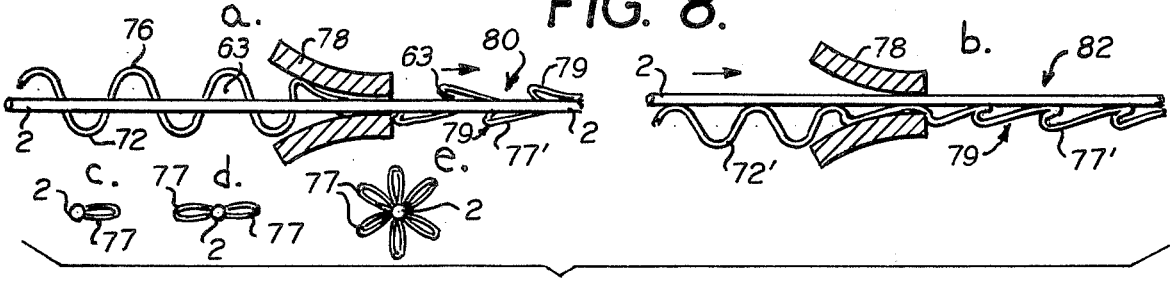
FIGS. 8*a* to *b* are diagrammatic views illustrating one way in which the team lattice fibers of FIGS. 7*b*, *d*, *g*, *i* and *j* have their loops biased or oriented.
FIGS. 8*c*, *d* and *e* are cross-sectional views of team lattice fibers depicted in FIGS. 7*b*, *d*, *g*, *i* and *j*; and in FIGS. 8*a* to B, which have one, two and six loop rows formed by a number of wavy axial elements attached to a central element.

A further method for the formation of a team lattice fiber is illustrated in FIGS. 7*a* through *j*. In this embodiment an undulated or helical axial member is bonded to one or more linear member. The transverse components of contorted member provides the bridge elements of the teamed lattice fiber. The composite fiber 60 is formed (FIGS. 7*a* and 7*b*) by bonding an undulating axial element 12 to two linear axial members 62 at points of contact 64 or at intersections 65. In another embodiment (FIGS. 7*c* and 7*d*) two linear axial elements 62 are bonded to a helical axial element 30 to form the composite fiber 66 at at least some points of contact 64. FIG. 62*e* depicts in perspective the said element 60 and illustrates that the linear axial members 62 may contact the helical axial member 30 either from the outside of the helix or from the inside of the helix. In the embodiments of the present invention, some of which are represented in FIGS. 7*a* through *j*, one, two, or a multiplicity of linear members and may be used in conjunction with one or more contorted members. For example, FIGS. 7*f* and 7*g* illustrate the manner in which the composite team fiber 70 is formed by bonding a spiral axial element 30 to a linear element 62 at points of contact 64. FIGS. 7*h*, *i* and *j* illustrate two methods which produce two different composite elements 74 and 76 from a linear axial member 62 and an axial member 72 having a wave structure with crests and troughs 73. Crests 73 of element 72 may be rounded or angular and are bonded at points of contact 64 to produce the composite fiber 74. When the crimped and/or curly elements 72 is superimposed over the linear element 62 so as to repeatedly cross it and bond in this assembly to at least a portion of the crossing junctions 65 the fiber 76 is obtained. The composite fibers 70, 72 and 76 have loops 63 oriented radially relative to the fiber axis. These loops can be oriented by distortion to point, for example, in one direction obliquely to the axis of the fibers as FIGS. 8a and 8b illustrate. The loops 63 of the fiber 76 can be given a slant by passing through a forming die 78 to produce a new fiber 80 having slanted loops 77 attached to a linear member 2 in two rows of loops 79 and 79'. Fiber 72, when passed through the forming die, produces a new fiber 82 having one row 79 of slanted loops 77. FIGS. 8*c*, *d* and *e* are cross-sectional views of fibers equipped with rows of loops represented by fibers 70, 74, 76 80 and 82. FIG. 8*c* is a cross-sectional representation of the fibers 72, 74 or 82 having one row of loops; FIG. 8*d* corresponds to fibers 76 or 80 and FIG. 8*e* is a cross-sectional view of a embodiment of longitudinal team lattice fiber having six longitudnal rows of loops.

Figure 9:
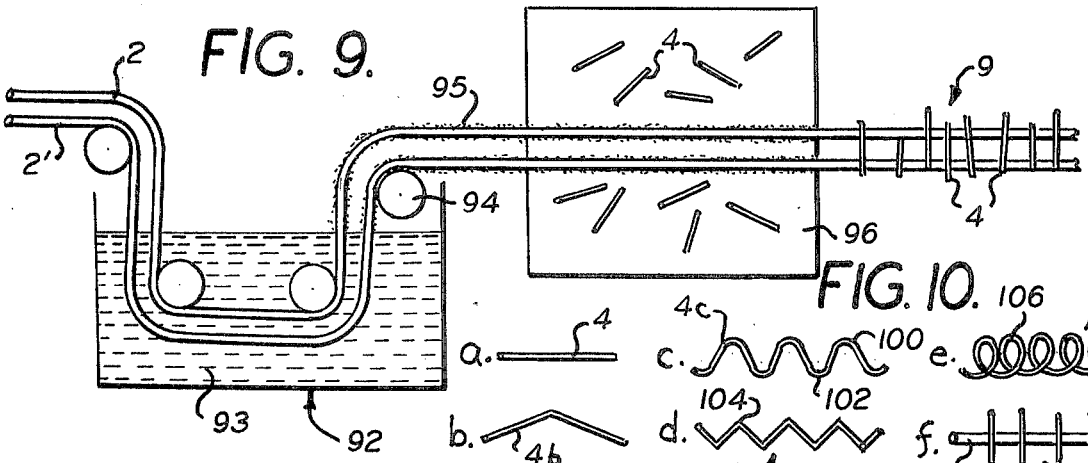
FIG. 9 is a diagrammatic view illustrating one embodiment of a method in which a plurality of axial elements is coated with an adhesive and thereafter contacted with a mass of transverse elements which adhere to both axial elements and then together to form one of the team lattice fibers.
Figure 10:
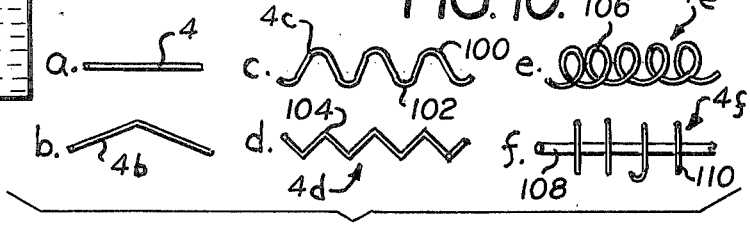
FIGS. 10*a* through *f* are side views illustrating several embodiments for the transverse elements that can be used to join the axial elements to form team lattice fibers of the present invention.

FIG. 9 illustrates one embodiment for a method for the production of the team lattice fibers of the present invention. Two accompanying axial filaments 2 and 2' are coated with adhesive 93 to produce a tacky pair of fibers 95 which contacted with bridge members 4 in the chamber 96. The bridge members 4 bond the two axial filaments 2 and 2' which, after the solidification of the adhesive 93, yield the team lattice fiber 9. Examples of various shapes of the bridging members 4 are depicted in FIG. 10*a* through *g*: FIG. 10*a* portrays a linear member; FIG. 10*b* an angular member; 10*c* a wavy member with rounded crests and troughs; 10*d* a crimped and/or curled member with angular crests and troughs; 10*e* a spiral member; 10*f* a linear member with crosswise nibs; and 10*g* a bridge member in the form of a platelet.

The team lattice fibers of the present invention can be produced from any synthetic or natural material. For example, polyesters, polyamides, polyimides, rayon, acetate and triacetate, other cellulose derivatives, acrylics, polyolefins, polyvinyl derivatives, protein base polymers, glass, cotton, flax, ramie, wool and other animal hair, metals and metallized fiber or film can be used in their manufacture. The fibers can be utilized alone or used as a component in non-woven materials, in spun yarn, and in woven, knitted, or otherwise made textiles. The described fibers are also valuable in areas outside of the textile field.

What is claimed is:

1. A composite textile filament comprising at least two synthetic or natural textile filaments selected from the group consisting of polyesters, polyamides, polyimides, rayon, acetate, rayon triacetate, cellulose, acrylics, polyolefins, polyvinyl derivatives, protein-based polymers, glass, cotton, flax, ramie, wool and animal hair extending side by side in the axial direction, said filaments being joined by a series of individual transverse textile fibers selected from the group consisting of textile fines, cotton linters and silk rod which join said filaments extending side by side in the axial direction into said composite filament.

2. A composite textile filament according to claim 1 which is of indefinite length.

3. A composite textile filament according to claim 1 comprising at least three of said synthetic or natural textile filaments extending side by side in the axial direction, said filaments being joined together by series of said individual transverse textile fibers in a three-dimensional non-planar geometrical arrangement.

* * * * *